US005113737A

United States Patent [19]

Grerory

[11] Patent Number: 5,113,737

[45] Date of Patent: May 19, 1992

[54] SEVEN STRING ELECTRIC GUITAR

[76] Inventor: Alex Grerory, 10863 Fruitland Dr., Studio City, Calif. 91604

[21] Appl. No.: 636,416

[22] Filed: Dec. 31, 1990

Related U.S. Application Data

[63] Continuation-in-part of Ser. No. 436,559, Nov. 14, 1989.

[51] Int. Cl.[5] ..... G10D 1/08; G10D 3/06

[52] U.S. Cl. ..... 84/267; 84/293

[58] Field of Search ..... 84/267, 291, 293, 298, 84/299, 313, 304, 306, 312, 314, 290, 291, 293

[56] References Cited

U.S. PATENT DOCUMENTS

| | | | |
|---|---|---|---|
| Re. 31,722 | 11/1984 | Steinberger | 84/327 |
| 3,302,507 | 2/1967 | Fender | 84/267 |
| 4,142,436 | 3/1979 | Chapman | 84/1.16 |
| 4,188,850 | 2/1980 | Kaman | 84/291 |
| 4,372,187 | 2/1983 | Berg | 84/1.16 |
| 4,383,466 | 5/1983 | Shibuya | 84/313 |
| 4,428,273 | 1/1984 | Favron | 84/317 |
| 4,501,185 | 2/1985 | Blucher | 84/1.15 |
| 4,539,887 | 9/1985 | Bjerkas | 84/314 R |
| 4,951,543 | 8/1990 | Cipriani | 84/298 |

*Primary Examiner*—L. T. Hix
*Assistant Examiner*—Eddie C. Lee
*Attorney, Agent, or Firm*—Ladas & Parry

[57] ABSTRACT

The invention is an electric guitar that has seven strings and a scale length of 25.5 inches. The highest string is a "top A" string that provides the guitarist access to higher notes than is available on a conventional guitar. This seven string guitar is constructed on a solid body and has a neck with twenty-four frets. The neck has "pronounced tapering" such that the proportionate relationship of the neck at the 24th fret and at the nut is greater in the present relationship than in the Fender Stratocaster guitar. The solid body has cut-aways on each side of the neck to permit fingering access to all the frets. The guitar has staggered headmachines so that the headmachine upon which the "top A" string is wound has a shorter post than those headmachines upon which the lower strings are wound. The guitar also has a vibrator bridge unit that is firmly connected to the solid body by two connecting screws and less than firmly attached to the solid body by two stabilizing screws. The vibrator bridge unit further has saddles mounted at maximum height to increase the sustain on the sounds generated by the guitar. A shim is placed between the neck and solid body to tilt the neck backwards to offset the raising of the strings by the raised saddles.

11 Claims, 4 Drawing Sheets

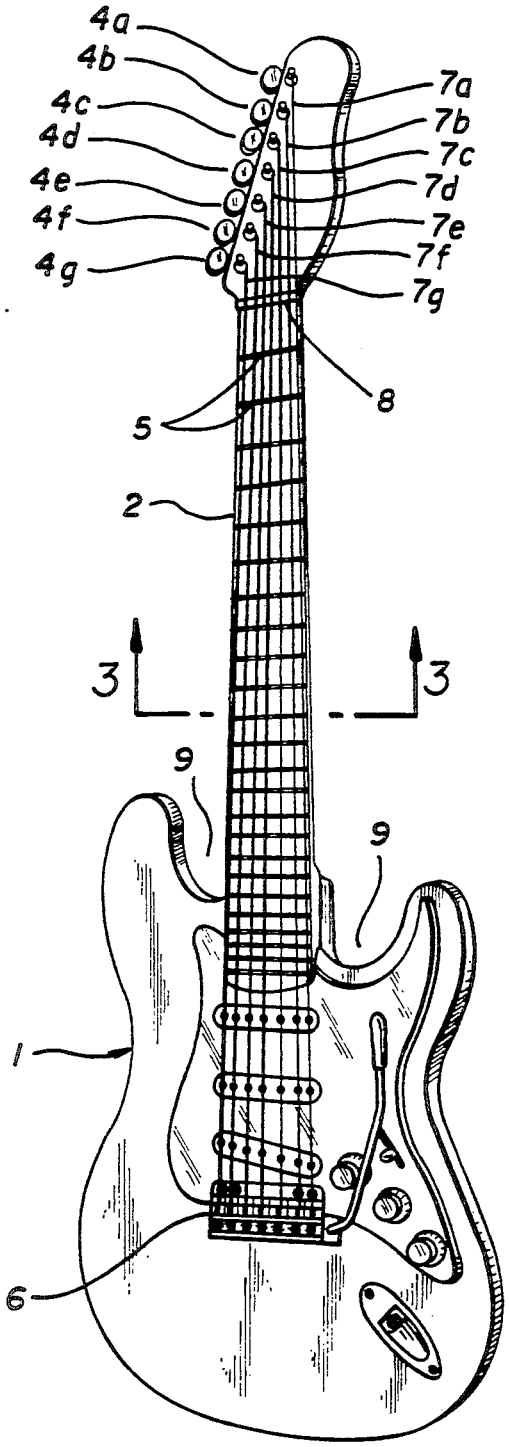
FIG. 1
FIG. 2
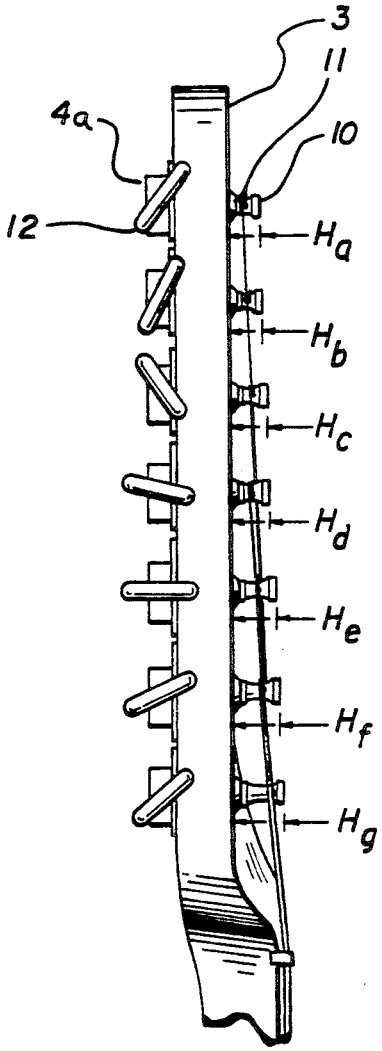
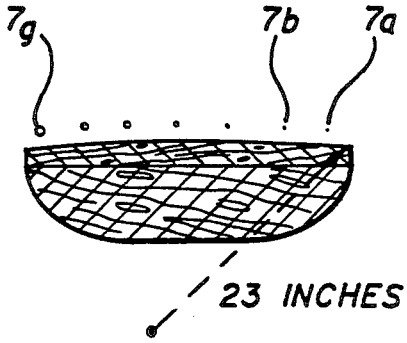
FIG. 3

FIG. 4
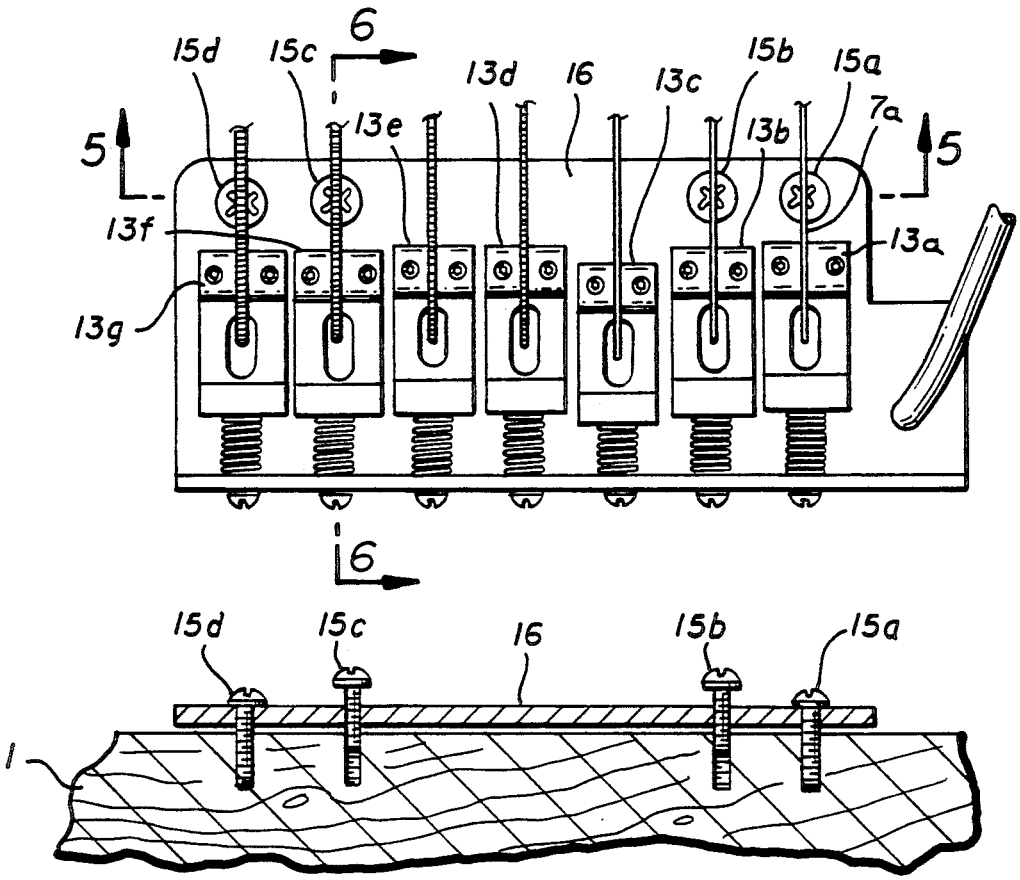
FIG. 5
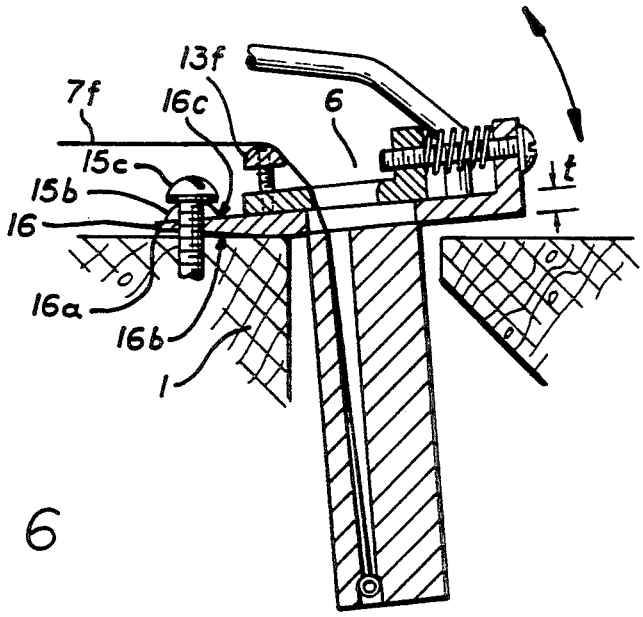
FIG. 6

SEVEN STRING ELECTRIC GUITAR

CROSS REFERENCE TO RELATED APPLICATION

This application is a continuation-in-part of U.S. Ser. No. 436,559, filed Nov. 14, 1989.

BACKGROUND OF THE INVENTION

1. Field of the Invention

This invention pertains to the field of electronic musical instruments, and more particularly to electric guitars.

Description of the Prior Art

An electric guitar has been well known in the art for many years. It is a standard and indispensable instrument for rock and jazz musicians. The electric guitar has also been increasingly used in the realm of classical music. However, the conventional electric guitar has a number of shortcomings that make it less than adequate in the performance of classical music.

One problem is the limited range of notes that can feasibly be played on the guitar. Prior art guitars do not have the range of, for example, a violin which is needed to perform many classical pieces. Guitar makers have attempted to extend the range of a guitar in a variety of ways. One attempt involved making a guitar with added frets on the neck of the guitar in order to reach higher notes. Another was the addition of a seventh string to the standard six-string guitar. These normally involved the addition of a lower B string so that the guitar could be used to play jazz music. Prior art attempts to add a "top A" were not workable because this added string was so thin and fragile that it broke very easily. These previous 7-string guitars were also made hollow so as to produce a "clean" sound. These earlier examples of 7-string guitars were not made with a vibrato because, being made for jazz, they had no need for a "rock tool", which the vibrato is.

A second problem was that the higher notes would be played with very little "sustain" in its sound. This was so whether the string was played very high up on a fret or, in the case of a seventh string, the string was so thin, and had so little mass that the sound became lifeless. A sustained sound is important if the guitar is to be able to play many of the classical pieces that are now played by violins. Of course, the violin has no such problem because it has a bow which, when slid against a string, provides an excellent sustained sound.

This inventor has previously attempted to devise a workable seven string guitar. The previous attempt proved to be unworkable. The following table compares the inventor's previous attempt and the present invention:

| Previous Seven String Guitar | Present Seven String Guitar |
|---|---|
| 1. Reverse headstock | 1. Non-reverse headstock |
| 2. Standard non-staggered headmachines | 2. Staggered headmachines |
| 3. No shim between neck and body | 3. Shim between neck and body |
| 4. 25 inch scale length | 4. 25½ inch scale length |
| 5. Standard tapering Stratocaster neck | 5. Pronounced tapering of neck |
| 6. Front mounted bridge | 6. Top mounted bridge |

The accumulation of the improvements made over the previous attempt results in a workable and very playable seven string instrument.

This invention constitutes an improvement on the vintage Fender Stratocaster Guitar. The description of the invention utilizes the vintage Stratocaster as a point of reference. There are two comprehensive publications on the Fender Stratocaster Guitar: "The Fender Stratocaster" by A. R. Duchossior published by Hal Leonard Publishing Corporation (1988); and "Fender Stratocaster" published by Guitar Magazine (November, 1987). These two publications are incorporated by reference into this application and copies of each are attached as Exhibits I and II, respectively.

SUMMARY OF THE INVENTION

The present invention provides an improved electric guitar that can be used to play classical music as well as rock music. In fact, because of the invention's range of notes and sustained sound, for the first time, a guitarist will be able to play beautiful classical pieces originally written for violin, such as the pieces written by Paganini, note for note.

A feature of the invention is that it has a newly developed seven-string vibrato bridge system. This vibrato system is extremely important both from an artistic point of view as well as from a marketing point of view. From an artistic perspective, the vibrato or this invention is essential to facilitate a "sustain" that is necessary to the playing of classical music. To this end, the invention's vibrato bridge system was designed to have a baseplate with a thickness of 0.09 inch. This is an important feature in order to be able to set saddles at maximum height with a small neck shim of 0.012 inch to obtain greatly enhanced sustain and natural ringing of the string. To obtain both flexibility and sustain, the vibrato-bridge system is top-mounted with four screws, two of which act as "stabilizers" and the other two acting as "connecting screws". From marketing perspective, the vibrato is important in that an electric guitar will typically not sell well without it.

A second feature of the invention is a seventh string that is a "high A". This seventh string adds the additional range that is necessary to play even the most challenging pieces by Paganini, for example. Until this invention, guitars could not be made with the additional "high A" because of the propensity to string breakage and lack of sustain.

A third feature of the invention is the use of staggered headmachines. This is necessary to create a progressively greater angle of the string between the nut and the headstock towards the top A, which would otherwise have the least angle of all and therefore the least tension between the string and the nut. Without the staggered headmachines, the top A string may be floppy and vibrate. This would require the use of a string tree to urge the string down toward the headstock between the headmachine and the nut. This effectively increases the angle of the string between the nut and headstock. The increased angle of the string would result in an increase in the tension of the string causing it to be too tight and break. By appropriately lowering the headmachine, the tension of the string is increased so that it is not floppy, but not increased so much as to cause breakage, which is more apt to occur when a string tree is used. The use of a suitably chosen lowered headmachine solves the fragility problems with the high string as well as improving immensely the stability of the intonation of the instrument when using the vibrato.

A fourth feature of the invention is that it has a scale length of 25.5 inches and 24 frets instead of the more standard 21 or 22 frets. The longer scale allows fingering above the 12th fret with a comfort not available with a shorter scale. Because of a double cut-away construction, the total 24 frets are now usable.

A fifth feature of the invention is that it has a solid body so that it can be overdriven to simulate a rock or sustained violin-like sound.

A sixth feature of the invention is that the neck has "pronounced tapering". "Pronounced tapering" refers to the aspect of the invention wherein the proportionate relationship of the neck width at the 24th fret and at the nut is greater in the present invention than in the Fender Stratocaster guitar. "Pronounced tapering" is important for comfort and playability.

BRIEF DESCRIPTION OF THE DRAWINGS

In describing the invention, reference will be made to the accompanying drawings wherein:

FIG. 1 is a top plane view of the guitar.

FIG. 2 is a side view of the headstock of the guitar and the headmachines mounted thereon.

FIG. 3 is a cross-sectional view of the neck and strings of the guitar as indicated in FIG. 1 as 3—3.

FIG. 4 is a top view of the vibrato bridge unit.

FIG. 5 is a cross-sectional view of the vibrato bridge unit as indicated in FIG. 4 as 5—5.

FIG. 6 is a cross-sectional view of the vibrato bridge unit as indicated in FIG. 4 as 6—6.

DETAILED DESCRIPTION

Figure 7:
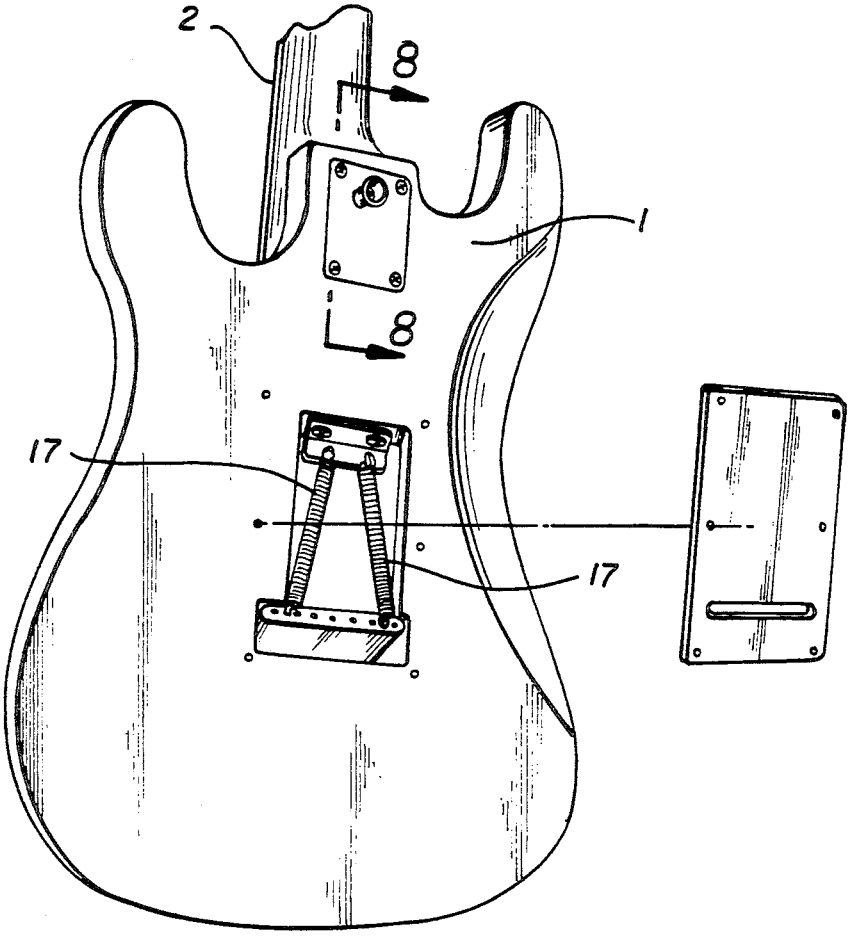
FIG. 7 is an exploded bottom view of the solid body of the guitar with a view of the springs connecting the vibrato bridge unit to the solid body.

Referring now to the drawings, there is illustrated in FIG. 1 a top plane view of the seven-string guitar. The guitar has a solid ashwood body 1 and a neck 2 connected to the solid body 1. One type of wood that may be used to make the body is ashwood. The neck has a headstock portion 3 upon which is mounted seven staggered headmachines *4a–4g*. The neck 2 has twenty-four frets 5 and has a scale length, the distance from a nut to the bridge saddles, of 25.5 inches. Top-mounted on the solid body is a vibrato bridge unit 6. The guitar has seven strings *7a–7g*, an end of each string 7 being attached to a headmachine and the other end of the strings 7 being connected to the vibrato bridge unit 6. Each string 7 compressively rests on a nut 8 situated between the frets 5 and the headmachines *4a–4g*. Although the thicknesses of the strings 7 can vary, in the preferred embodiment, standard strings would be used for the lowest six strings *7b–7g* with an added highest string *7a*. Starting with the lowest string, the standard set comprises: a wound low E string with 0.042 inch diameter, a wound low A string of 0.032 inch diameter, a wound D string of 0.024 inch diameter, a G string of 0.016 inch diameter, a B string of 0.0115 inch diameter and a top E string of 0.009 inch diameter. The seventh string *7a* is a top A string of 0.006 inch diameter. The use of a standard set of strings is important for commercial success since 70% of the guitar strings used today are of the above description for strings *7b–7g*. Other set gauges can be used but then, of course, the seventh string *7a* would necessarily be of a different diameter. The solid body 1 has double cutaways 9 near the neck 2 of the guitar so that the guitarist will have access to the frets 5 located on the neck nearest to where the neck 2 is joined to the solid body 1.

FIG. 2 provides a more detailed view of the staggered headmachines *4a–4g*. Each headmachine provides the mechanism for tuning a string 7 of the guitar. The headmachine has a post 10 around which a string is wrapped, a base portion 11 that is located adjacent to the headstock 3, and a tuning lever 12 which, when turned, rotates the post 10. The posts are of "staggered" or "varying" heights and are noted in FIG. 2 as Ha–Hg. In the preferred embodiment, the posts 10 are of the following heights: The posts associated with the top A and top E strings are each ⅛th of an inch high; the posts associated with the B and G strings are each 15/16th of an inch high; and the posts associated with the D, low A and low E strings are each 1 inch high. Standard Kluson type vintage Stratocaster headmachines used on Stratocasters have 1 inch high posts. When installed onto the headstock 3 of the guitar and held in place by base plates 11, the posts rise from the surface of the headstock by the following distances: The posts associated with the top A and top E strings are 5/16 of an inch; the posts associated with the B and G strings are each 6/16 of an inch, and the posts associated with the D, low A and low E strings are 7/16 of an inch. For optimum performance, the B string *7c* should be wrapped around its associated post 1¾ rotations, the top E string *7b* should be wrapped around its associated post 3 rotations and the top A string *7a* should be wrapped around its associated post 5 rotations.

The staggered headmachines *4a–4g* are an important feature because unless the headmachines associated with the higher tone and thinner strings are lowered with respect to the headstock 3, those strings 7 would not be pulled tightly enough against the nut 8 and would tend to flop and vibrate against the nut 8 during playing. A possible remedy would be to utilize a string tree but this would result in string-breakage problems for the thin top A string.

FIG. 3 illustrates a cross-sectional view of the neck 2. The neck 2 is specially designed for comfort and a visually balanced look, both of which are essential from a marketing point of view. Because the neck 2 is necessarily wider to accommodate the additional seventh string *7a*, the neck 2 must be modified so that the guitar can comfortably be held and manipulated by the guitarist. To this end, the general radius of the neck 2 has been increased to 23 inches as indicated in FIG. 3.

Figure 9:
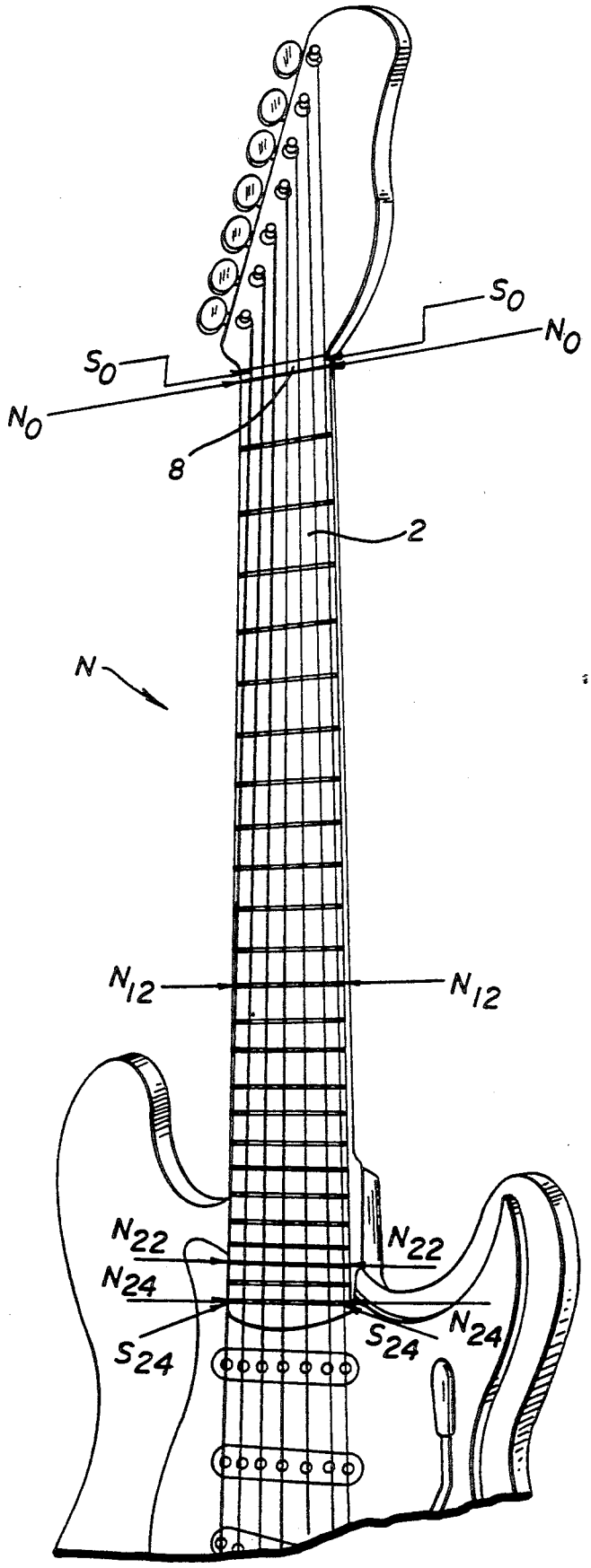
FIG. 9 is a plan view of the guitar's neck depicting the preferred neck width specifications.

FIG. 9 should be referred to as an illustration of the width dimensions of the neck N. The subscripts refer to the associated fret number. In the preferred embodiment, the width of the neck 2 at the nut 8 ($N_o$–$N_o$) is 1 ½ inch (approximately 1.875 inch or 47.6 mm); the width of the neck 2 at the 12th fret ($N_{12}$--$N_{12}$) is approximately 2 11/32 inch (about 2.36 inch or 59.9 mm). The width of the neck at the 22nd fret ($N_{22}$–$N_{22}$) is approximately 2 18/32 inch (2.56 inch or 65 mm); and the width of the neck 2 at the 24th fret ($N_{24}$–$N_{24}$) is approximately 2 21/32 inch (about 2.67 inch or over 67 mm). The thickness of the neck 2 between the nut 8 and the first fret is 0.845 inch; the thickness of the neck at the 12th fret is 0.902 inch; and the thickness of the neck 2 at the neckjoint between the 17th and 18th frets is 0.982 inch. The distance between the central axes of the top A string and low E string at the nut is substantially 1 20/32 inch. The distance between the central axes of the top A string and the low E string at the bridge is approximately 2 20/32 inch. Consequently, the distance between the central axes of the top A string and low E string at the 24th fret is 2 12/32 inch.

The proportionate relationship of the neck width at the 24th fret and at the nut 8 is greater in the present invention than in the Fender Stratocaster or other comparable guitars. This feature is known as "pronounced tapering" and is important for comfort and playability. The practical effect of "pronounced tapering" is that the guitarist is provided with a neck that "feels" like that of a six string guitar. The neck, as measured at the nut, is wider to accommodate the additional seventh string. However, it is not proportionately wider, i.e., it is not an additional 1/6 as wide. Rather, the increase in width is less than 1/6 as wide as that of the Stratocaster. The following illustrates this point. The standard stratocaster has a neck width at the nut of about 1.685 inch. Increased by 1/16, the width of the neck at the nut for a seven string guitar should be 1.97 inch. This compares with a neck width at this nut for the present invention of 1.875 inch. This gives the guitarist the feel of a six string guitar. However, the neck flares outward towards the lower part of the neck because the spacing between the strings at the vibrato saddles 13 (FIG. 4) is the same as that in the large strat vintage saddles. Because the trend of modern day guitar making is to use saddles that are narrower than the vintage Stratocaster saddles, this feature of "pronounced tapering" runs counter to the direction of the art. By going counter to the trend, a surprising result is reached wherein superior ease and playability is attained by the feature of "pronounced tapering". It should be noted that the dimension specified above for the width of various portions of the neck are preferred but may vary. An important feature is the relative greater proportion between the lower portion of the neck to the upper portion of the neck when comparing the present invention to the Fender Stratocaster and other comparable guitars. The following exemplifies this feature. Since the widths of the neck of the Vintage Stratocaster are 1.68 inch and 2.225 inch at the nut and last fret respectively, this ratio is 1.317. The "last fret" is the fret on the neck that is remotest from the nut. For the present invention, the widths of the neck at the nut and last fret are 1.875 inch and 2.67 inch, respectively. This results in a ratio of 1.424.

FIGS. 4–6 illustrate the vibrato bridge unit 6. The vibrato bridge unit 6, preferably has a vintage FEDDER bridge/vibrato baseplate thickness t of 0.09 inch. The vibrato bridge unit 6 also has seven saddles 13*a*–13*g* upon each of which is mounted one of the seven strings. The thickness of the vibrato bridge unit 6 is essential to setting the saddles 13*a*–13*g* at maximum height. The bottom E, top E and top A strings are mounted on saddles 13*g*, 13*b* and 13*a*, which are attached by 5/16 of an inch screws 13.1 while the low A, D, G and B strings are mounted on saddles 13*f*–13*c* that are attached by ⅜ inch screws 13.1. Because the saddles 13*a*–13*g* are set at maximum height, a small neck shim 14 of 0.012 inches is inserted between the neck 2 and the solid body 1 so that the neck 2 is tilted backward permitting the string to be located in closer proximity to the frets on the neck 2. If the saddles 13*a*–13*g* are not set at maximum height, a different tension is created in the bridge area. By setting the saddles 13*a*–13*g* at maximum height, the sustained and natural ringing of the strings 7*a*–7*g* is greatly enhanced by the increased tension exerted on the string by the raised saddles.

The vibrato bridge unit 6 is mounted onto the solid body 1 by four screws 15*a*–15*d*. Two of the screws are connecting screws 15*a*, 15*d* that are located on extreme ends of a top mounting portion 16 of the vibrato bridge unit 6. These connecting screws 15*a*, 15*d* firmly connect the vibrato bridge unit 6 to the solid body 1. Two stabilizing screws 15*b*, 15*c* are each located inside of each of the connecting screws on the top mounting portion 16. Unlike the connecting screws 15*a*, 15*d*, the stabilizing screws 15*b*, 15*c* do not firmly adhere the vibrato bridge unit 6 to the solid body 1. Instead the screws are rotated less than firmly into the vibrato bridge unit with the result that the bottom flat portion of the screw head confronting the top mounting portion 16 of the vibrato bridge unit 6 is spaced from the vibrato bridge unit 6 by approximately 0.05 inch. By mounting the vibrato bridge unit 6 to the solid body 1 in this way, the sustained and natural rich ringing of the string, as well as the flexibility, is enhanced. If only two connecting screws 15*a*, 15*d* are used, when the vibrato bridge unit 6 is utilized, the connecting screws would necessarily be larger, requiring a front mounted bridge as used in the standard Floyde Rose bridge. But with a front-mounted vibrato bridge unit, much of the vibrato bridge unit 6 would tend to float above the solid body 1. This type of construction tends to maximize flexibility but, on the other hand, much of the natural resonance of the strings is not transferred to the solid body 1. On the other hand, if 4, 5, or 6 screws are firmly embedded into the solid body 1 of the guitar, resonance would be increased but the vibrato bridge unit 6 would lack flexibility. An ideal medium is therefore reached by utilizing two connecting screws 15*a*, 15*d* and two stabilizing screws 15*b*, 15*c*. This construction permits the bridge 6 to touch the body 1 and therefore communicate resonances and sustain otherwise lost. The stabilizing screws assure that the holes in the body will not enlarge because of the strain put on otherwise only two small screws. As best viewed in FIG. 6, the construction of the vibrato bridge unit is conventional, like that of the Vintage Stratocaster except that it is wider to accommodate the additional saddle. The top mounting portion 16 is inclined on its side facing the body 1 from edge 16*a* until first point 16*b*. First point 16*b* is located below second point 16*c*, the point where each screw 15*a* and 15*d* contacts the top mounting portion as the vibrato unit is actuated. First point 16*b* is slightly closer to the axis of screws 15*a* and 15*d* than second point 16*c*. By enhancing the flexibility of the vibrato bridge unit 6 with this construction, jerky movement of the unit, and therefore the friction exerted on the strings, is minimized. This, in turn, minimizes breakage and tuning stability problems.

Figure 8:
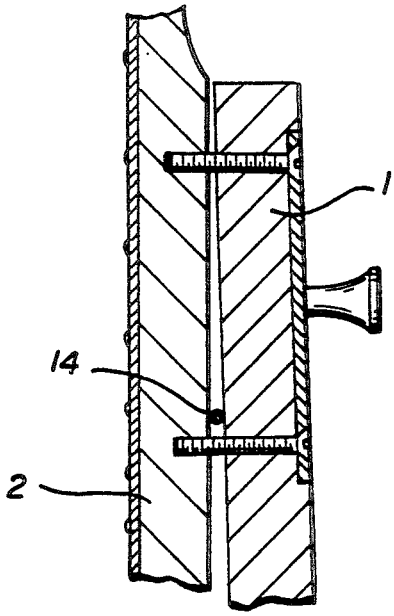
FIG. 8 is a cross-sectional view of the guitar at the area where the neck is connected to the solid body of the guitar with a shim placed therebetween as indicated in FIG. 7 as 8—8.

The vibrato bridge unit 6 has two springs 17 that connect the vibrato bridge unit 6 to the solid body 1. This is best viewed in FIG. 7. FIG. 8 illustrates the insertion of a shim 14 between the neck 2 and the solid body 1 so that the neck 2 is tilted backwards. The use of the shim 14 offsets the setting of the saddles 13*a*–13*g* at maximum height and permits the various strings to engage closely with the nut 8.

It should be borne in mind that the drawings are not rendered in actual scale so that certain features of the invention can be brought out and depicted.

The drawings and the foregoing description are not intended to represent the only form of the invention in regard to the details of its construction and manner of operation. In fact, it will be evident to one skilled in the art that modifications and variations made be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

The invention is claimed as follows:

1. A neck for a guitar featuring pronounced tapering, said neck having a width of substantially 1 ⅞ inch at a nut and said neck having a width of substantially 2 21/32 inch at a 24th fret.

2. A neck as claimed in claim 1 wherein said neck has a width of substantially 2 11/32 inch at a 12th fret.

3. A neck as claimed in claim 2 wherein said neck has a width of substantially 2 18/32 inch at a 22nd fret.

4. A neck as claimed in claim 1 wherein said neck has a general radius of 23 inches.

5. A neck as claimed in claim 1 wherein at said nut an axis of a highest tonal string is substantially 1 20/32 inch from an axis of a lowest tonal string and at the 24th fret, an axis of the highest tonal string is approximately 2 12/32 inch from an axis of the lowest tonal string.

6. A neck for use in a seven-string guitar, said neck having a scale length of 25 ½ inch, a nut and 24 frets mounted thereon, said neck having a width of substantially 1 ⅞ at said nut and a width of 2 21/32 inch at a 24th fret from said nut.

7. A guitar neck as claimed in claim 6 having a width of substantially 2 11/32 inch at a 12th fret from the nut.

8. A guitar neck as claimed in claim 7 having a width of substantially 2 18/32 inch at a 22nd fret from the nut.

9. A neck for a seven-string guitar having a nut and a plurality of frets thereon, said neck having a first width at said nut and a second width at a fret remotest of said frets from said nut, wherein a proportionate relationship of said second width to said first width is 1.424.

10. A neck as claimed in claim 9 wherein the number of frets is 24.

11. A guitar comprising:

seven strings, the strings comprising a top A string, a top E string, a B string, a G string, a D string, a low A string, and a low E string;

a body;

a vibrato bridge unit, said vibrato bridge unit having saddles upon which said strings each are mounted, said saddles adjustably fastened to said vibrato bridge unit by associated screws, each said saddle set at maximum height on said associated screws;

means for mounting said vibrato bridge unit to said body;

a neck attached to said body, said neck having a scale length of 25 ½ inches, a nut and 24 frets, said neck having a width of substantially 1 ⅞ inches at a nut, a width of substantially 2 18/32 inches at a 22nd fret from said nut and a width of 2 21/32 inches at a 24th fret from said nut;

shim means disposed adjacent said neck and said body so that said neck is tilted away from said body at an end of said body furthest from said vibrato bridge unit; and wherein at said nut, an axis of said top A string is substantially 1 20/32 inch from an axis of said low E string and at said 24th fret from said nut, an axis of said top A string is substantially 2 12/32 inches from an axis of said low E string.

* * * * *

UNITED STATES PATENT AND TRADEMARK OFFICE

CERTIFICATE OF CORRECTION

PATENT NO. : 5,113,737

DATED : May 19, 1992

INVENTOR(S) : Alex Gregory

It is certified that error appears in the above-identified patent and that said Letters Patent is hereby corrected as shown below:

On the title page, top left side, Change "Grerory" to --Gregory--.

Item [76], the inventor's name should be corrected to read, --Alex Gregory--.

Item [57], In the Abstract,

Line 16, "vibrator" should be --vibrato--.
Line 19, "vibrator" should be --vibrato--.

Column 4, Line 20, "1/3th" should be --7/8th--.

Column 4, Lines 59-61, "1 1/2" should be --1 7/8--.

Signed and Sealed this

Third Day of August, 1993

*Attest:*

Michael K. Kirk

MICHAEL K. KIRK

*Attesting Officer*

*Acting Commissioner of Patents and Trademarks*